US006225611B1

(12) United States Patent
Pearcy et al.

(10) Patent No.: US 6,225,611 B1
(45) Date of Patent: May 1, 2001

(54) MICROWAVE LYOPHILIZER HAVING CORONA DISCHARGE CONTROL

(75) Inventors: Timothy E. Pearcy, Minnetonka, MN (US); Ronald R. Lentz, Modesto, CA (US)

(73) Assignee: Hull Corporation, Warminster, PA (US)

( * ) Notice: Subject to any disclaimer, the term of this patent is extended or adjusted under 35 U.S.C. 154(b) by 0 days.

(21) Appl. No.: 09/440,242

(22) Filed: Nov. 15, 1999

(51) Int. Cl.[7] ..... H05B 6/64; F26B 3/34

(52) U.S. Cl. ..... 219/679; 219/712; 34/259; 34/289

(58) Field of Search ..... 219/712, 752, 219/679, 680, 710, 702; 34/259, 263, 265, 255–258, 287, 289

(56) References Cited

U.S. PATENT DOCUMENTS

| | | | |
|---|---|---|---|
| Re. 31,241 | | 5/1983 | Klaila . |
| 2,360,108 | | 10/1944 | Christie . |
| 2,513,991 | | 7/1950 | Bradbury, III . |
| 2,662,302 | | 12/1953 | Cunningham et al. . |
| 2,859,534 | | 11/1958 | Copson . |
| 3,048,928 | | 8/1962 | Copson et al. . |
| 3,264,747 | | 8/1966 | Fuentevilla . |
| 3,270,428 | | 9/1966 | Van Olphen . |
| 3,271,874 | | 9/1966 | Oppenheimer . |
| 3,276,138 | | 10/1966 | Fritz . |
| 3,474,543 | | 10/1969 | Bender et al. . |
| 3,571,940 | | 3/1971 | Bender . |
| 3,708,886 | | 1/1973 | Ogle . |
| 3,731,392 | * | 5/1973 | Gottfried ..... 34/291 |
| 3,743,714 | | 7/1973 | Deutsch . |
| 3,955,286 | | 5/1976 | Anrep . |
| 4,001,944 | | 1/1977 | Williams . |
| 4,015,341 | | 4/1977 | McKinney et al. . |
| 4,033,048 | | 7/1977 | Van Ike . |
| 4,060,911 | | 12/1977 | Weiler et al. . |
| 4,067,683 | | 1/1978 | Klaila . |
| 4,096,283 | | 6/1978 | Rahman . |
| 4,103,431 | | 8/1978 | Levinson . |
| 4,182,946 | | 1/1980 | Wayne et al. . |

(List continued on next page.)

OTHER PUBLICATIONS

Corona Discharge Detection and Measurement, Intertec Publishing Corp. http://www.pcim.com/articles/1998/art0004/art1.html*

*Primary Examiner*—Teresa Walberg
*Assistant Examiner*—Tu B. Hoang
(74) *Attorney, Agent, or Firm*—Merchant & Gould P.C.

(57) ABSTRACT

A lyophilizer system is adapted for operation in a first mode or a second mode with microwave assisted drying. The system includes a lyophilizing chamber, including shielding from microwaves. The chamber is connected to a pressure controller for controlling vacuum in the lyophilizing chamber and a device for trapping water vapor. One or more microwave generators, direct microwaves into the lyophilizing chamber. Refrigeration units lower the temperature of the lyophilizing chamber and condenser. The chamber environment maintains a temperature and a pressure that facilitates sublimation in the chamber in a first mode, and for creating a chamber environment having vacuum and temperature such that when combined with microwaves directed into the chamber, facilitates sublimation in the chamber in a second mode. The chamber has arc inhibiting surfaces and shielding and a corona discharge detection and control system, including optical, thermal and other detection systems.

30 Claims, 8 Drawing Sheets

U.S. PATENT DOCUMENTS

| | | | |
|---|---|---|---|
| 4,198,554 | | 4/1980 | Wayne . |
| 4,204,336 | | 5/1980 | Le Viet . |
| 4,250,139 | | 2/1981 | Luck et al. . |
| 4,275,511 | | 6/1981 | Parkinson et al. . |
| 4,286,389 | | 9/1981 | Ogle . |
| 4,330,946 | | 5/1982 | Courneya . |
| 4,341,803 | | 7/1982 | Koshida et al. . |
| 4,468,865 | | 9/1984 | Inagaki . |
| 4,492,839 | | 1/1985 | Smith . |
| 4,521,975 | | 6/1985 | Bailey . |
| 4,566,403 | | 1/1986 | Fournier . |
| 4,601,260 | | 7/1986 | Ovshinsky . |
| 4,622,448 | | 11/1986 | Awata et al. . |
| 4,631,380 | | 12/1986 | Tran . |
| 4,664,924 | | 5/1987 | Sugisawa et al. . |
| 4,671,951 | | 6/1987 | Masse . |
| 4,671,952 | | 6/1987 | Masse . |
| 4,673,560 | | 6/1987 | Masse et al. . |
| 5,948,144 | * | 9/1999 | Cifuni ..... 95/246 |

* cited by examiner

MICROWAVE LYOPHILIZER HAVING CORONA DISCHARGE CONTROL

BACKGROUND OF THE INVENTION

1. Field of the Invention

The present invention is directed to an improved system for lyophilizing with microwaves and an improved method for microwave lyophilization.

2. Prior Art

Lyophilization, or freeze drying, as it is more commonly known, is used in a number of different industries to remove water from materials to achieve a more stable pure product with a prolonged shelf life. The process is used in the pharmaceutical and food industries which require lyophilization systems that are capable of producing environmental processing conditions to effect sublimation so that the water is removed from processed materials. The water vapor is drawn off from the lyophilization chamber and typically removed by trapping on a refrigerated condenser surface, desiccants or other suitable devices.

Sublimation is a process wherein materials change from a solid phase directly to a gaseous phase without passing through a liquid phase. With water, ice turns directly to water vapor without first melting to a liquid form, and then evaporating. Sublimation can occur at various temperatures and pressure combinations, but typically sublimation needs low temperatures and a vacuum pressure less than atmospheric. Sublimation provides advantages for materials processing as purity is maintained and the processed material does not have to be subjected to high temperatures, such as would be needed to boil off the water.

Although traditional lyophilization systems have worked well for their intended purpose, they have several shortcomings. Traditional lyophilization systems must attain subzero temperatures and create vacuum conditions to provide atmospheric processing conditions that facilitate sublimation. These types of lyophilization systems have shortcomings that lessen their usefulness. Such systems require large amounts of energy for refrigeration equipment, for creating and maintaining the vacuum, and for providing the heat, primarily through convection and conduction, for sublimating the ice and warming the product and the system. In addition, to compound the high energy consumption, such traditional lyophilization processes are very time consuming. Often, the freeze drying may take a week or more, creating a bottleneck in the material processing. To accommodate high production needs, the size of the freeze drying systems must be quite large to handle large batches. Furthermore, should problems develop during the freeze drying process, large batches of material may be damaged. As the systems require large amounts of energy to maintain the atmospheric conditions for an extended period of time, the operating costs are high, thereby increasing the total cost of processing the product.

To increase the speed of the drying process and to decrease the amount of energy required for heating, including energy necessary to heat the mass of shelving for radiation, convection and conductive heating of the material to be processed, systems and methods have been developed that use microwaves to aid freeze drying. Although for freeze drying, such systems still require vacuum and a condenser or other system for collecting the liberated water vapor, the energy needed to maintain temperatures for sublimation is decreased as microwaves are used in the sublimation process. Such systems achieve freeze drying of the materials, but do so in greatly reduced time periods.

Processing taking several days or a week or more with conventional lyophilization may now be performed in less than a day, and in many cases, several hours. The microwaves provide the energy of sublimation directly to the materials being processed, alone or in combination with radiation, convection and/or conduction, so that sublimation occurs much more efficiently.

Though microwaves have been used to speed the freeze drying process, and are successful when operated and controlled correctly, there are problems associated with such systems. Prior microwave systems operating under vacuum conditions suffer from uncontrollable corona discharge, which occurs when high electric fields ionize gases within the freeze drying chamber. Sharp edges of metallic objects can enhance the local electric field and ignite gases and create a corona discharge. Such occurrences of corona discharge create localized temperature spikes that may cause localized overheating or melting, adversely affecting the materials near the occurrence. This affects the quality of the freeze dried product, since many products, including many pharmaceutical and biological products are temperature sensitive, have very high quality standards. Corona discharge can be fatal to the success of the freeze drying process. Non-uniform microwave coverage can also adversely affect the quality of the product being processed.

Heretofore, prior art microwave systems have not employed a method of successfully reducing or eliminating corona discharge within the freeze drying chamber. Moreover, such systems have not employed detectors to sense when corona discharges occur. Even if they had detected problems, such systems do not have controls to adjust conditions in response to detected arcing in order to minimize or eliminate the occurrences of corona discharge in time to reduce damage to the product.

Examples of freeze drying apparatuses using microwaves to assist in drying are shown in U.S. Pat. Nos. 2,859,534 and 3,020,645 to Copson, and U.S. Pat. NO. 3,048,928 to Copson et al. Although the Copson patents teach microwave friendly trays to limit discharge in the processing chamber, and removing condensation coils from the inner processing container, no additional steps are shown or suggested to actively control and monitor microwave discharge. U.S. Pat. No. 3,264,747 to Fuentevilla teaches a microwave assisted freeze drying apparatus using non-conductive materials such as Plexiglas to contain the product. Although microwaves are utilized, there is no system for detection, control, and/or elimination of corona discharge.

A major hurdle with detection systems is that temperature sensors typically are made of materials that, if extended into the microwave field, would create further discharges. Therefore, traditional temperature, pressure, and other sensors to be placed within the microwave field often cannot be utilized without modification.

It can be seen then that a need exists for a new and improved system for microwave assisted lyophilization. Such a system should greatly reduce the time and energy required to uniformly freeze dry the material being processed. In addition, such a system utilizing microwave energy should be configured to minimize the potential effects of corona discharge within the lyophilization chamber. The system should provide microwave distribution to all materials placed in the chamber and provide relatively uniform processing of the materials in the chamber. Such a lyophilization system should also utilize detectors and controls to detect the occurrence of actual and/or incipient corona discharges and to adjust the microwave field strength and other system characteristics to promptly eliminate corona discharges when detected. The present invention addresses these as well as other problems associated with microwave lyophilization systems.

SUMMARY OF THE INVENTION

The present invention is directed to a microwave assisted lyophilization system and a method for lyophilizing using microwaves. The present invention provides a lyophilization chamber that is capable of creating pressures and low temperatures sufficient to create atmospheric conditions that are conducive to sublimation, and therefore lyophilization of the product. Such freeze drying may take extended periods, often several days, a week or more. In addition, the present invention may also be operated in a mode in which microwaves are introduced into the chamber to conductively heat the containers, which then add heat to the material being processed.

The present invention includes a lyophilization system capable of withstanding suitable ranges of pressure and temperature. The system must be capable of withstanding absolute pressures as low or lower than 1 mm Hg, and for many applications, pressures required for steam sterilization of the chamber. During lyophilization, temperatures in the system may range from highs above room temperature and lows below zero centigrade. In addition to the processing chamber, all components linked by air passages to the processing chamber must also be able to withstand the vacuum and/or pressure conditions. A conductive conduit generally extends from the chamber to a vapor trap, such as condenser or similar device, for trapping the water vapor from the product being dried. The water vapor may be generated in the lyophilization chamber, and passed into the condenser, where it is generally collected as ice. The refrigeration unit is in communication with the condenser and/or lyophilization chamber to create the low temperature conditions that are necessary for lyophilization.

In addition to the refrigeration system, a vacuum pump is in communication with the chamber and condenser to place the lyophilization chamber and condenser under vacuum for the lyophilization process. The lyophilization chamber and condenser contain sensors to monitor and/or control the various conditions such as temperature and pressure levels.

In a preferred embodiment, the various sensors and the cooling and vacuum units are connected to a central controller or processor to provide displays for monitoring, adjusting and optimizing the various characteristics for the most efficient and highest quality processing.

In addition to the vacuum and temperature conditions that facilitate removal of the water content from the product, microwaves may be utilized to facilitate sublimation and therefore drying of the product. The present invention uses one or more microwave generators to expose the contents of the lyophilization chamber to microwaves while under the preferred environmental conditions that also facilitate lyophilization.

The number and power level of the microwave generators may be varied depending on the requirements of the lyophilization system and the design and capacity of the chamber. However, it is important that the entire product area in the chamber have exposure to the microwave field so that lyophilization occurs substantially uniformly throughout the product being processed. Therefore, wave guides direct the microwaves toward the chamber at various angles and spacing to facilitate substantially uniform distribution of microwaves. For a given total microwave power level, the use of multiple generators or multiple wave guide openings lowers the electrical field strength at each opening, thereby lowering the likelihood of corona discharge. In addition, stirrers may be placed in the processing chamber to distribute microwaves and provide more nearly uniform levels of microwave energy throughout the product and improve processing quality. The microwave generators are also controlled by a central processor and may be manually or automatically adjusted depending on the desired processing of the product and the various temperatures and other conditions monitored and controlled during the processing.

According to the present invention, sealed wave guide windows are placed within the wave guides. Such windows are typically made from a material such as Teflon® that allows microwaves to pass through the window, while maintaining the pressure differentials across the windows. The windows have a pressure seal that withstands the vacuum and/or pressures created in the lyophilization processing chamber.

In addition to the problems created by the temperature and pressure ranges, the processing chamber encounters special problems from its exposure to microwaves. A common problem that occurs with microwaves is corona discharge, which may prevent speedy and high quality lyophilization and which has limited the commercial use of microwaves for lyophilization. To accommodate the microwaves, the processing chamber must be free of corona discharge base points, such as sharp metal edges or points. It has been found that metallic objects may be placed in the chamber as long as they do not provide such sharp edges and points that provide the base for an arc. As long as the various metallic objects are either shielded or rounded, the possibility of arcing and corona discharge occurring is greatly reduced. Therefore, the stirrer components, such as the stirrer drive shafts, are shielded and exposed surfaces are rounded. Any sensors placed within the chamber must be compatible with the microwave conditions. Temperature sensors and other sensors in the chamber must use fiber optic materials or the sensors must be shielded or remote from the microwave field. By using arc inhibiting surfaces, microwaves may be used effectively without causing corona discharge.

In addition to creating a lyophilization chamber that hinders formation of arcs, the present invention includes controls that monitor and detect corona discharge and allow for modifying chamber conditions to stop discharge from occurring. Various temperature sensors and/or photo detectors may be placed within the chambers. Should a corona discharge occur, there will be illumination and a local temperature spike. If sufficient sensors are placed in a spaced apart relationship throughout the chamber to form a sensor field, the location of such corona discharges can be determined. Incipient corona discharge can be monitored by measuring electric field strength and/or reflected power. If the location of discharges can be pinpointed, adjustments may be made in the power levels of one or more of the microwave generators and/or chamber atmospheric conditions, such as pressure and temperature, may be changed to eliminate further corona discharge. In addition to the sensors throughout the chamber, sensors may be placed proximate the wave guide windows so that arcing may be detected by the temperature sensors at each associated microwave generator. With monitoring and control available, the occurrence of corona discharge can be minimized and/or eliminated so that higher quality processing occurs and the products produced reflect that quality. In addition, as information on the conditions present to create a discharge is accumulated, processing conditions can be initialized and controlled based on accumulated processing information so that corona discharge free lyophilization may be achieved.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the present invention.

BRIEF DESCRIPTION OF THE DRAWINGS

Referring now to the drawings, wherein like reference letters and numerals indicate corresponding structure throughout the several views.

DETAILED DESCRIPTION OF THE PREFERRED EMBODIMENTS

Figure 1:
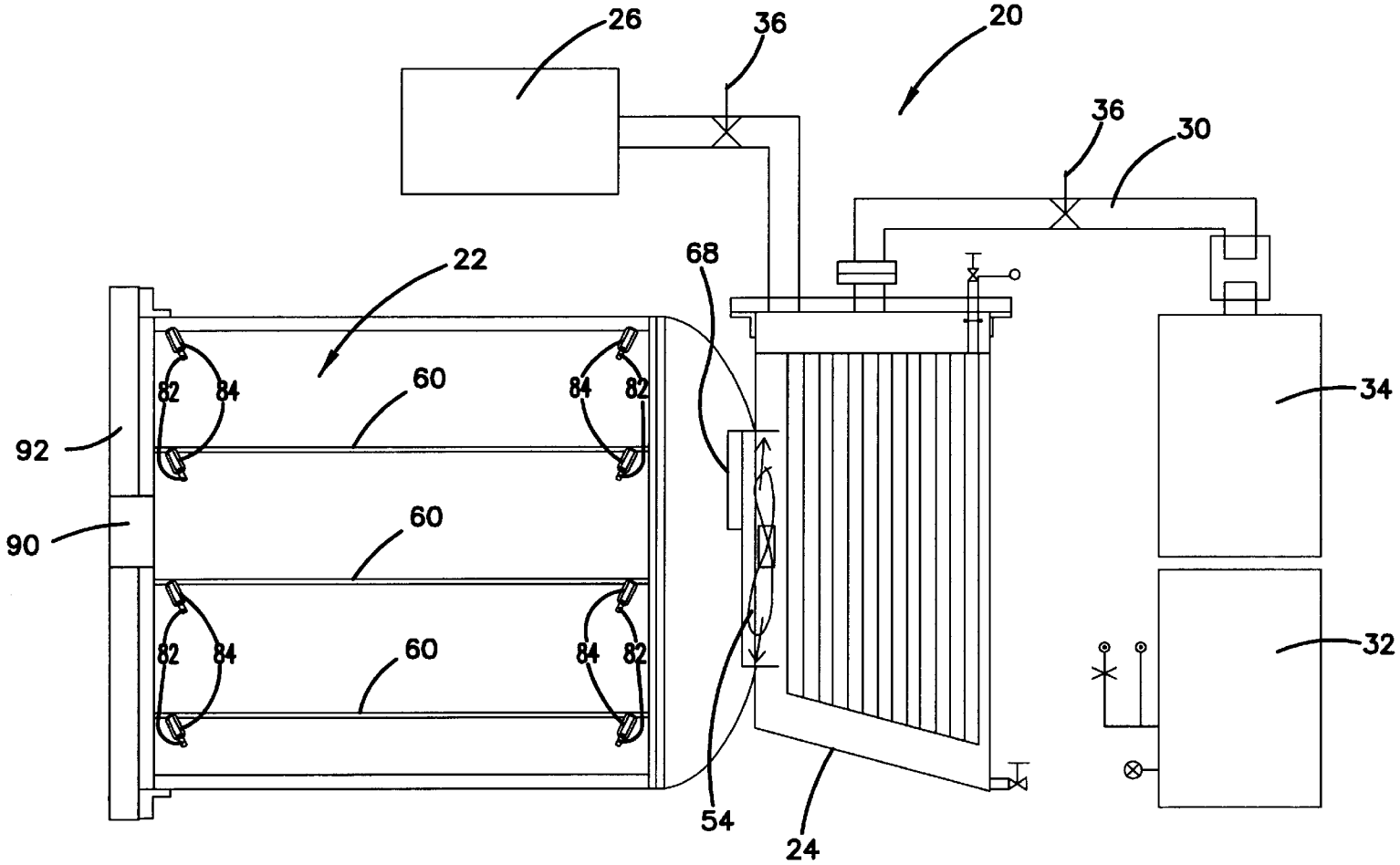
FIG. 1 shows a diagrammatic partial sectional view of a microwave lyophilizing system and associated atmospheric equipment according to the principles of the present invention.
Figure 2:
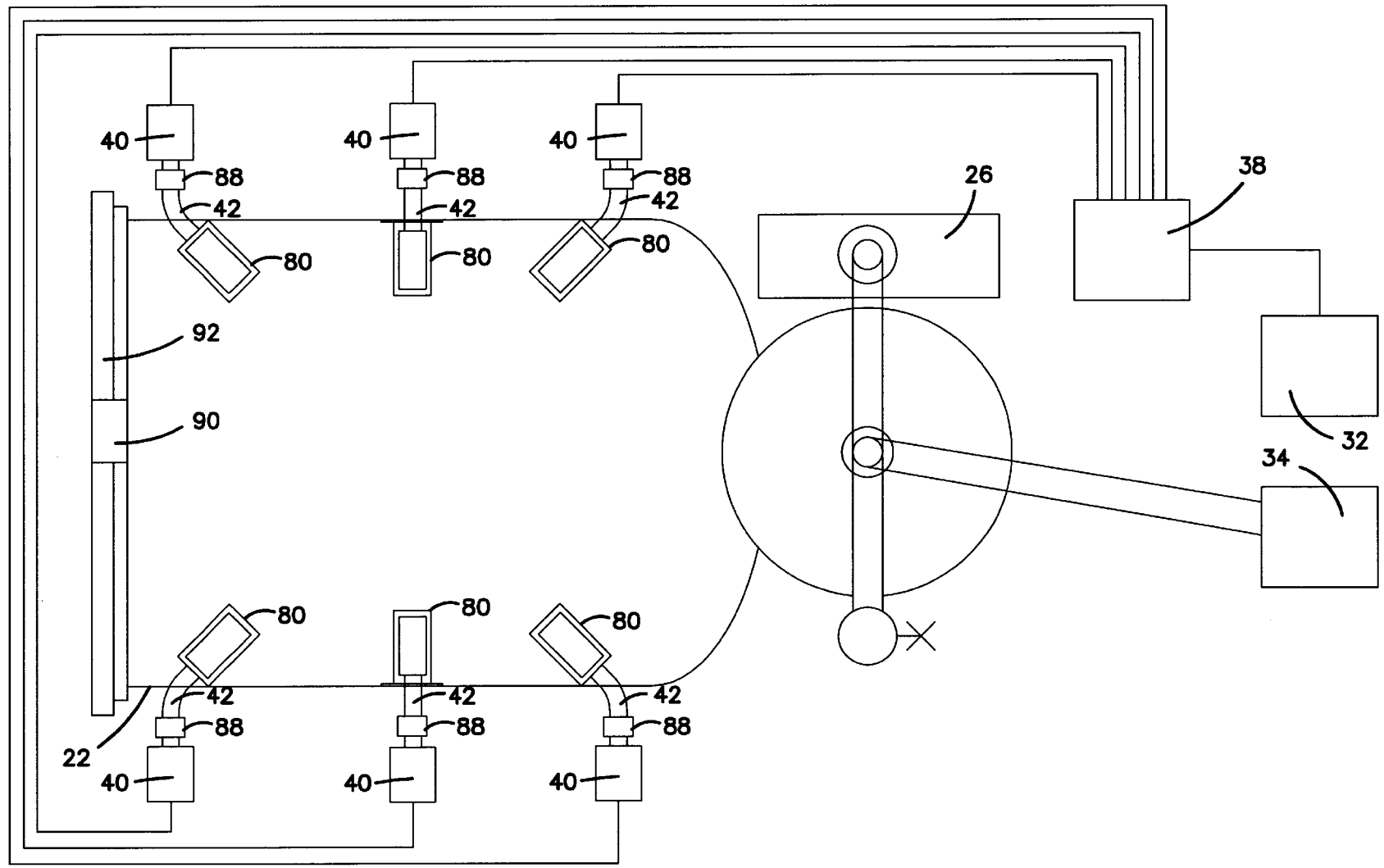
FIG. 2 shows a top plan view of the microwave lyophilizing system shown in FIG. 1.

Referring now to the drawings, and in particular to FIGS. 1 and 2, there is shown a microwave lyophilization system, generally designated 20. The lyophilization system 20 may be utilized as a conventional freeze drying system wherein the moisture is removed by creating atmospheric conditions that facilitate removal of the water content from the product. The atmospheric conditions include placing the system under vacuum and controlling the temperature so that direct sublimation occurs and ice changes directly to water vapor. The lyophilization system 20 includes a processing chamber 22 wherein the freeze drying process occurs. The chamber 22 includes a door 92 with monitoring window 90 formed therein. The door 92 preferably attaches to the chamber forming an opening to the full width of the chamber so that full width trays and material supported thereon may be easily inserted. The chamber 20 is preferably sealed to the door 92 with gaskets or other pressure seal devices to accommodate vacuum and pressure conditions. The chamber 20 should be capable of withstanding pressures as low or lower than 1 mm Hg, ranging to absolute pressures of several pounds per square inch.

Figure 3:
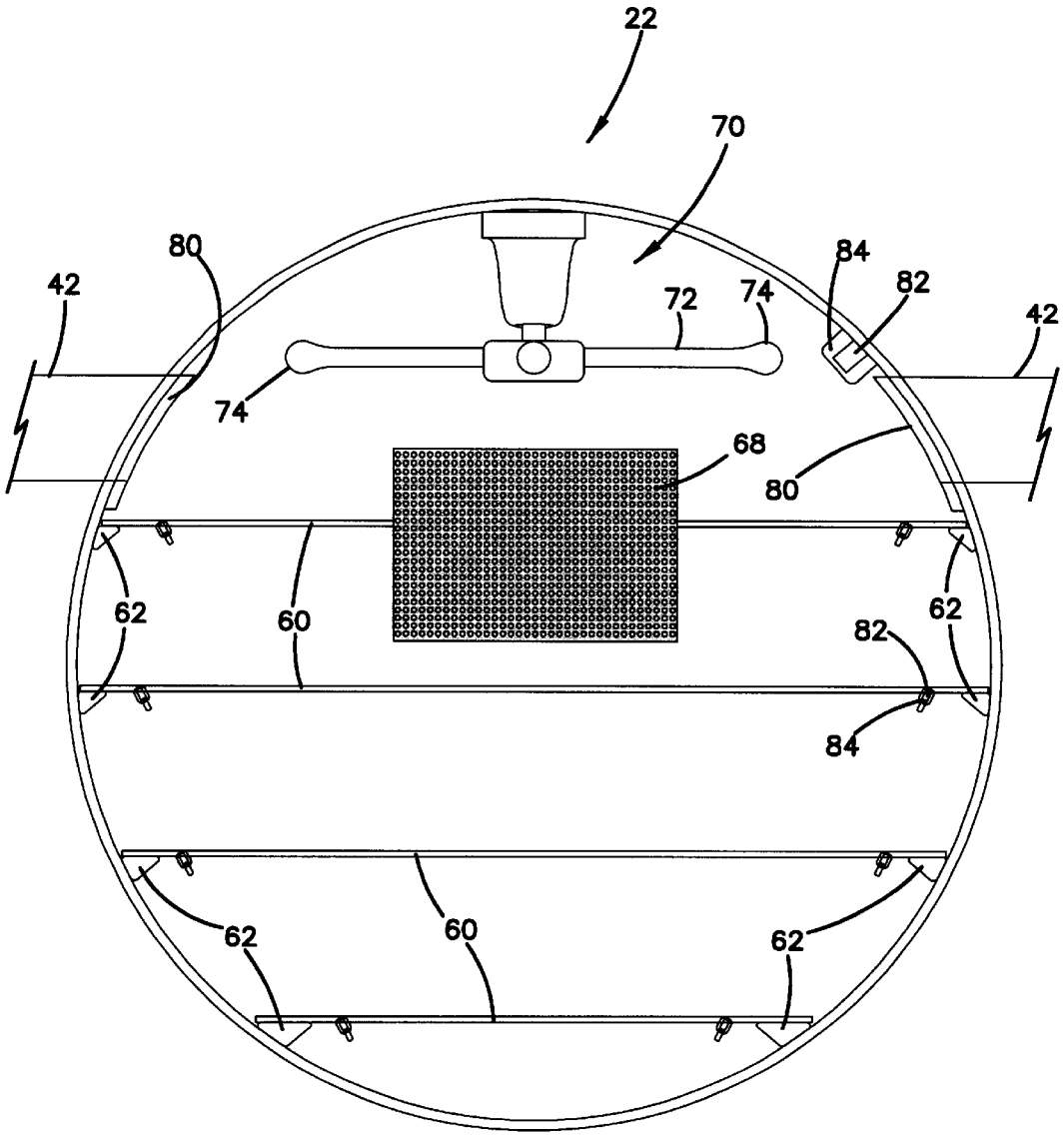
FIG. 3 shows an end sectional view of a lyophilizer chamber for the microwave lyophilization system shown in FIG. 1.

As shown in FIG. 3, the lyophilization processing chamber 22 also includes shelves 60 spaced apart within the chamber 22 to support the trays or vials containing material which is to be freeze dried. In one embodiment, the processing chamber 22 is substantially cylindrical so that greater pressure variations may occur in utilizing the inherent strength properties of a rounded geometry. However, other chamber configurations, such as rectangular, may be used. Shelf supports 62 may be molded or fastened to the walls of the chamber 22 to provide for easy removal and insertion of the product and trays.

As shown in FIGS. 1 and 2, to accommodate the removal of water vapor from the chamber 22, a condenser 24 or other vapor trap, such as a desiccant or similar device, is utilized. A fan 54 may be provided to facilitate circulation of air through the condenser 24 and back to the processing chamber 22. The fan 54 serves to lower the product chamber temperature, and in some cases, to freeze the material to be lyophilized. The air or other gases, may be recirculated by suitable pipes or ducts, providing a faster method for freeze drying the material being processed. Vacuum lines including isolation valves 36 connect the condenser 24 and processing chamber 22 to a vacuum pump 34. Refrigeration unit 26 also provides cooling to bring the chamber 22 to desired subfreezing temperatures. The pressure and temperature units 24 and 34 provide for creating atmospheric conditions which facilitate sublimation within the processing chamber 22.

Referring now to FIG. 2, the microwave lyophilization system 20 also includes a microwave generation system. One or more magnetrons 40 are in connection with a power unit 32 to generate microwaves directed into the chamber 22. In a preferred embodiment, wave guides 42 lead from each magnetron 40 to the processing chamber 22. To optimize delivery of microwaves and coverage of materials in the chamber 22, wave guides 42 may twist and bend with directional couplings 88 to direct microwaves into the chamber 22 at a desired location and orientation. Although the system is shown with each wave guide 42 having its own associated magnetron 40, and vice versa, other configurations are possible with a single magnetron 40 or other numbers of magnetrons and wave guides 42 to generate substantially uniform microwave coverage within the processing chamber 22. Each magnetron 40 could power more than one wave guide opening 80.

Figure 6:
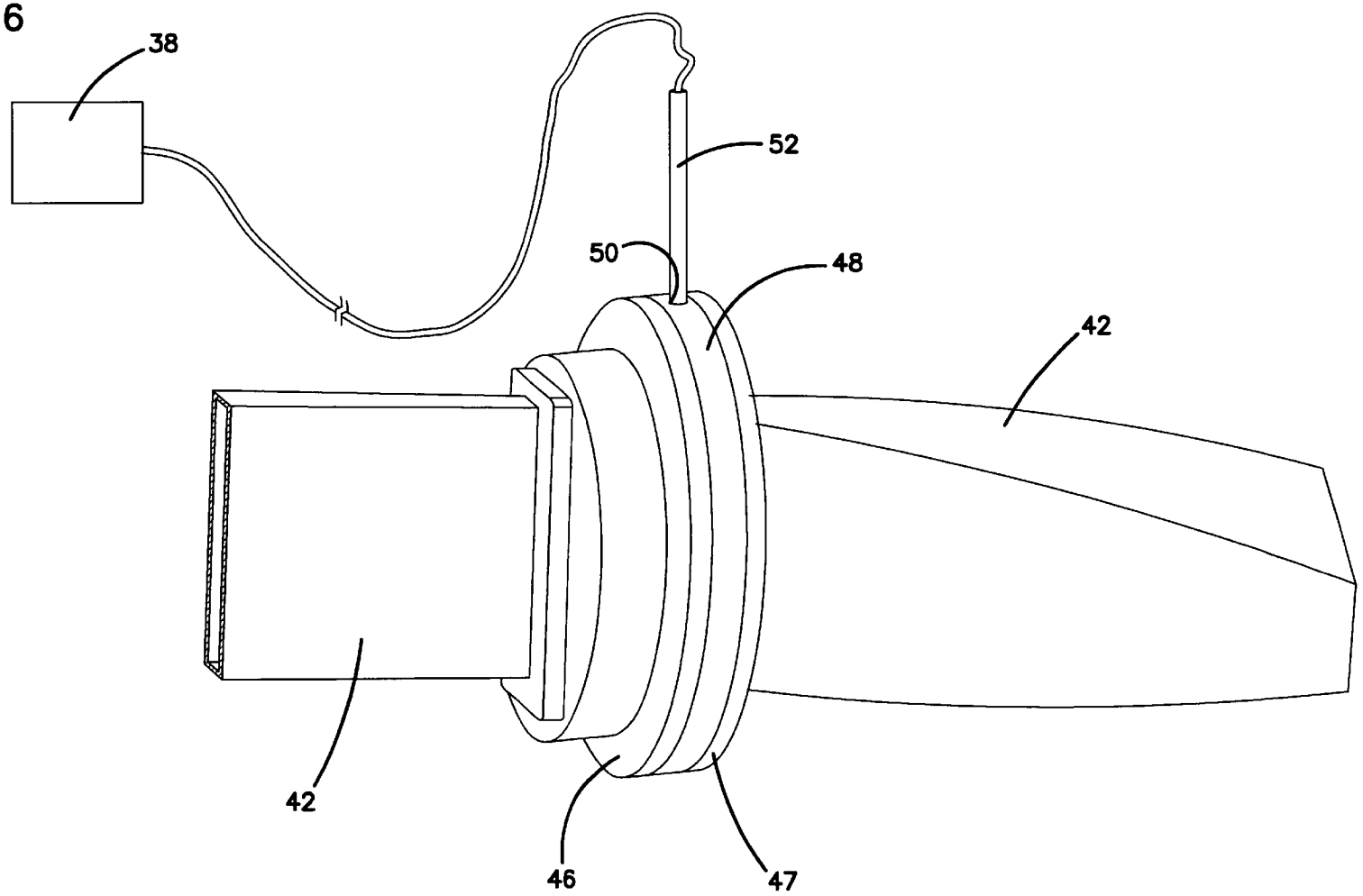
FIG. 6 shows a elevational view of a sensor for the lyophilization system shown in FIG. 1.
Figure 7:
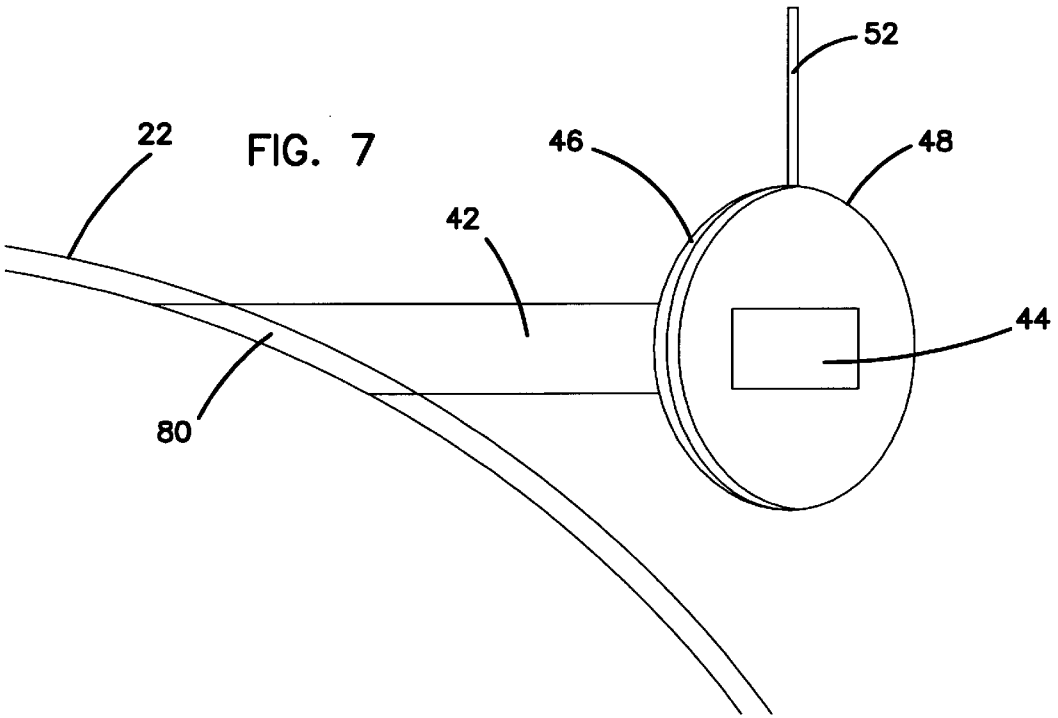
FIG. 7 shows a perspective view of a wave guide window for the lyophilization system shown in FIG. 1.
Figure 8:
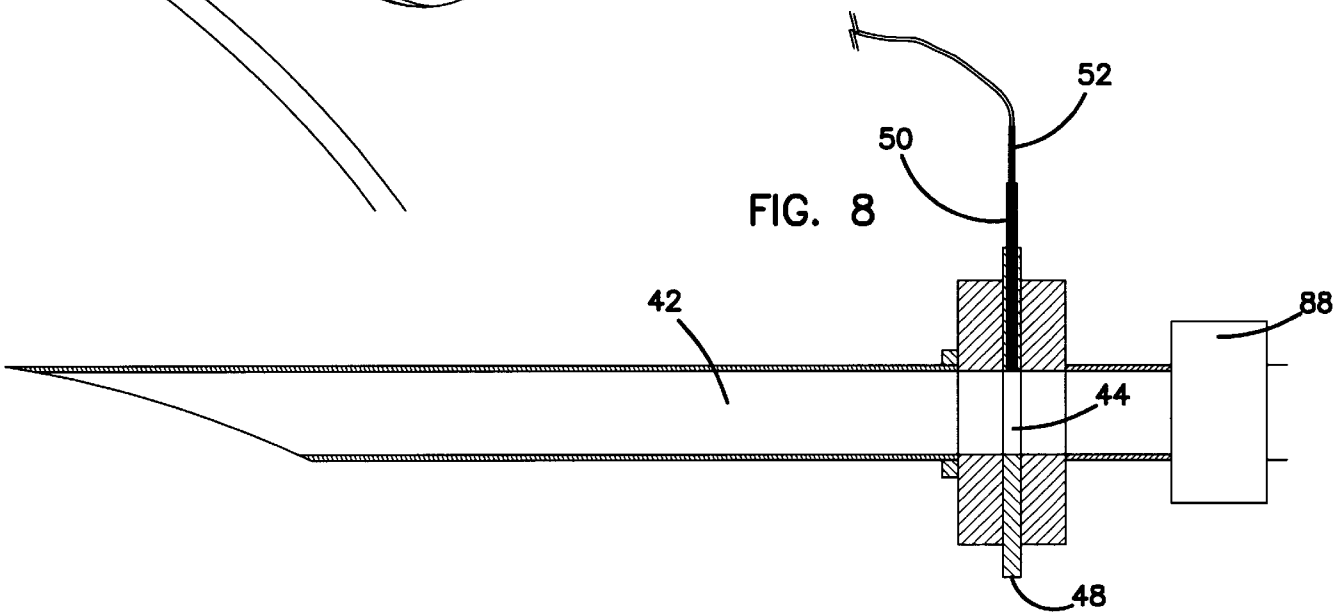
FIG. 8 shows a side sectional view of a wave guide and connection to the microwave chamber.

Referring to FIGS. 6, 7 and 8, as the chamber 22 is under vacuum with appropriate temperature and pressure ranges, a seal must be formed that can accommodate these pressures and maintain vacuum within the chamber 22. Choke flanges 46, wave guide window flanges 48, and complementary flanges 47 are utilized within the wave guides 42. The wave guide window flanges 48 lock a sealed wave guide window 44 within the wave guide 42. The wave guide window 44 is typically made of a material such as Teflon® that allows microwaves to pass through the window 44. The wave guide window 44 has seals to maintain the chamber vacuum and pressures. It also separates the wave guide generators 40 from vacuum, so that modifications to accommodate the pressure ranges are not needed. As explained hereinafter, corona discharge and arcing is a common problem with microwave processing. Therefore, a temperature sensor 52 is placed in the wave guide window flange 48 mounting to the choke flange 46. The wave guide window flange 48 may have a channel 50 formed therein for receiving the temperature sensor. With this configuration, temperature sensors 52 are shielded from the microwaves, yet are adjacent the wave guide window 44 where corona discharge may occur. Therefore, changes in temperature from an arc near the wave guide window 44 can be accurately detected with a sensor 52 extending downward in the choke flange 46. As the sensor 52 does not insert directly into the path of the microwave field, and is therefore shielded from direct exposure to the microwaves, it presents no surface which might be conducive to corona discharge arc.

Figure 9:
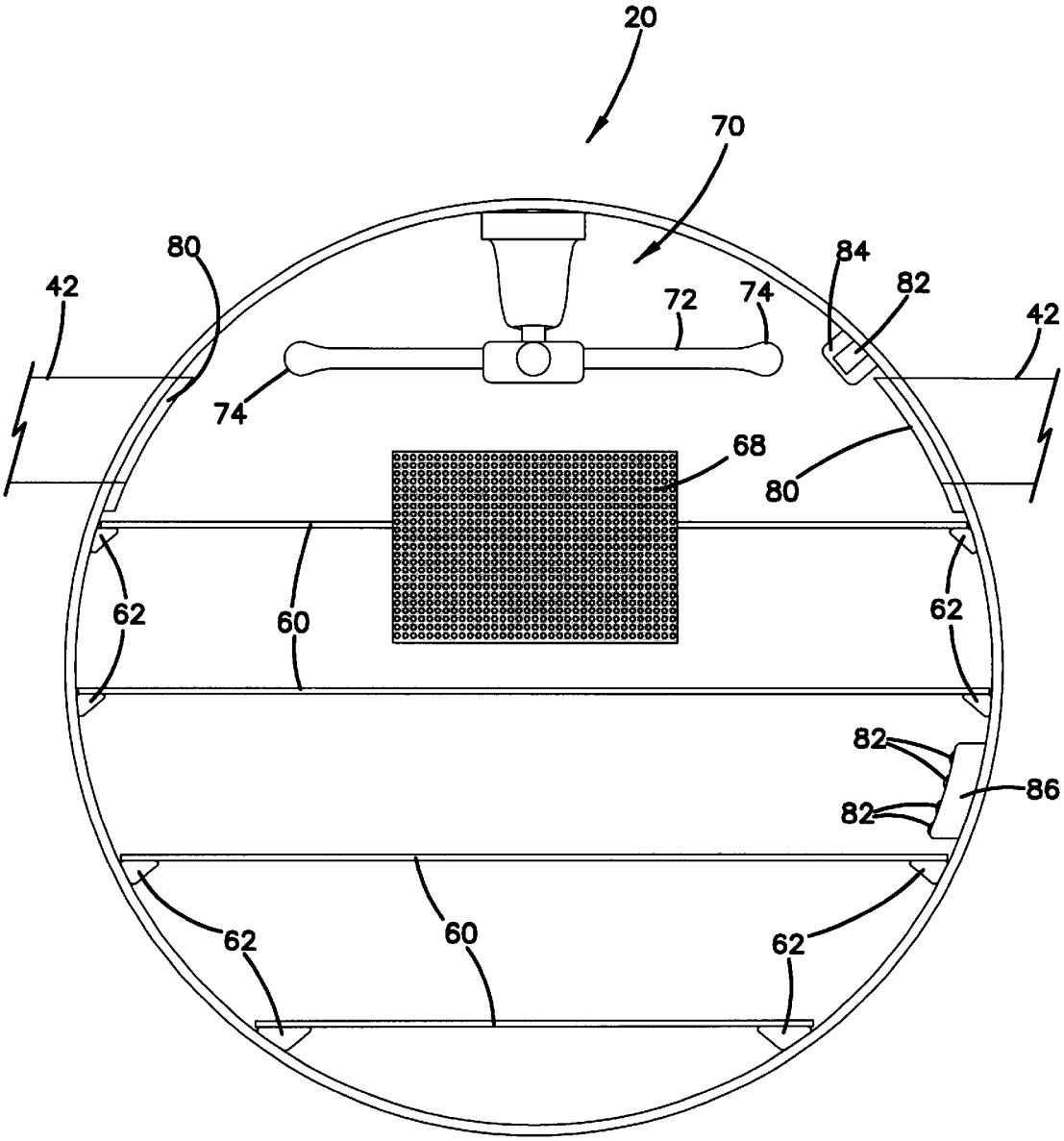
FIG. 9 shows an end sectional view of a lyophilizer chamber for the microwave lyophilization system shown in FIG. 1 with a sensor cluster.

Referring to FIG. 3, the processing chamber 20 must also be configured with arc inhibiting surfaces so that corona discharge is minimized and preferably eliminated. Therefore, the chamber 22 is configured so that materials having surfaces that may lead to corona discharge, including metallic fasteners, such as bolts and rivets, are eliminated or the materials are shielded, so that corona discharge cannot arc to the surfaces. In addition, the chamber 22 includes sensors 82 that include shielding 84 or may be made from non-metallic fiber optic materials. The sensors 82 may be temperature sensors, optical sensors, such as photo detectors, or other sensors capable of corona discharge detection, and are typically positioned in a spaced apart relationship to form a sensor array. The interior of the processing chamber 22 may be made of materials such as polypropylene with shelf supports 62 molded or attached to the walls of the chamber 22. Referring to FIG. 9, the chamber 22 may also include a shielded sensor cluster 86 having several sensors 82 grouped together and directed in various directions to cover the chamber 22.

Figure 5:
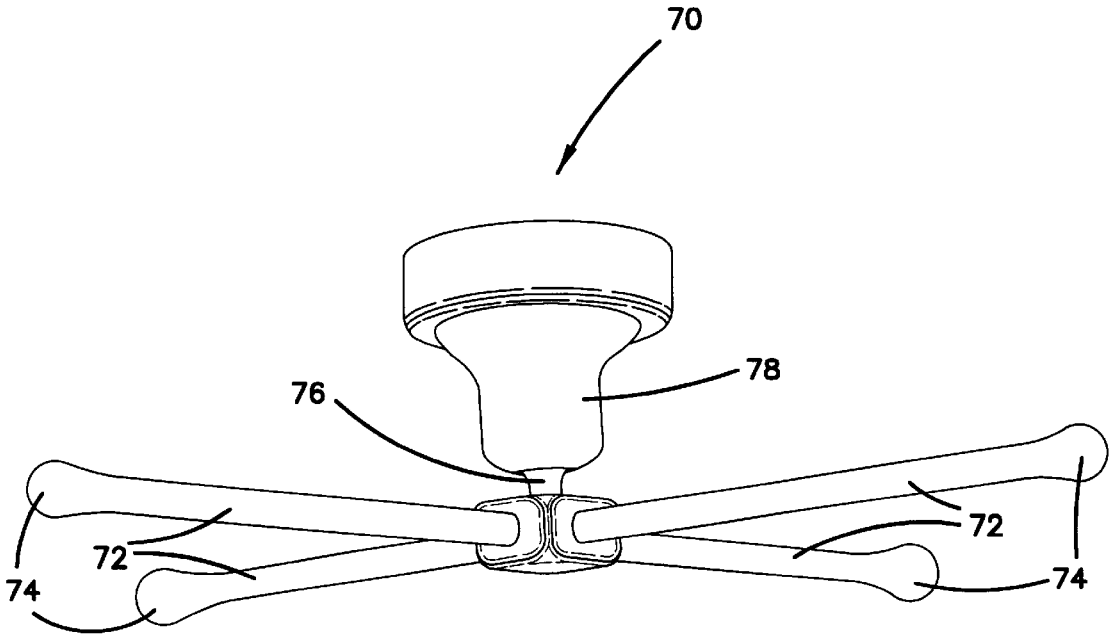
FIG. 5 shows a perspective view of a microwave stirrer for the lyophilization shown in FIG. 1.

As shown in FIGS. 3, 5 and 9, mode stirrers 70 may be located in the chamber 22 to redirect microwaves so that substantially the entire chamber 22 receives sufficiently uniform exposure to the microwaves. The mode stirrers 70 have a very slow rotation, but redirect microwaves sufficiently to expose the chamber 22 to achieve substantially complete microwave coverage. The stirrers 70 typically include blades 72 that include round shafts and preferably include rounded ends 74 for arc resistance. While the materials may be metallic, the surfaces are arc inhibiting, so that there are no sharp locations at which a discharge can be easily ignited. The welds and other attachments must be ground and smooth so that edges and points for arcing are not created. In addition to rounded elements, the shaft 76 of each stirrer 70 is shielded by a rounded bell-type housing 78. The shielding 78 covers stirrer bearings and other potentially sharp edges that are utilized for rotation and for extension of the stirrer 70 into the lyophilizing chamber 22.

The interior of the processing chamber 22 also includes openings 80 to the wave guides spaced about the chamber. As stated above, the chamber 22 may accommodate a number of different configurations of wave guides 42 that provide adequate coverage and exposure to the chamber 22. Greater or lesser power may be utilized with various configurations to provide sufficient microwave strength to optimize the freeze drying process.

In addition to temperature and pressure considerations, the chamber 22 must also be configured to contain the microwaves therein. The opening leading to the condenser or vapor trap 24 must include a shielding screen 68. The screen 68 must be configured to have sufficient openings for vapor flow, so that the air and/or water vapor entering the condenser has a sufficient flow rate to remove the water vapor from the processing chamber 22 and minimize the pressure differential between the chamber 22 and the condenser 24. However, the screen 68 must be configured so that the openings are sized to prevent radiation having a wave length of microwaves from passing through the screen 68 and heating material in the condenser 24. The door 92, window 90 and the walls of the chamber 22 are also designed to minimize microwave exposure to objects outside the lyophilization system 20.

Referring to FIG. 6, the sensors 52 in the window flanges 48, and the sensors 82 in the chamber 22, shown in FIG. 3, are in communication with a controller or central processing unit 38. The controller 38 accepts input from the various sensors 82 within the chamber 22 and the other components and provides control to those components. For example, if the temperature sensors provide indications of increased temperature, the microwave power to the processing chamber 22 or to a portion of the chamber 22 is manually or automatically adjusted. Therefore, a spike in the temperature due to a corona discharge will be processed by the controller 38 to determine which sensors 82 and/or 52 are detecting a temperature increase and modifying the power output of an associated magnetron 40 or combination of magnetrons accordingly to eliminate corona discharge. The sensors 52 and 82 may also include other sensor types, such as photo detectors that detect a flash from each occurrence of corona discharge. The controller 38 may also take input from sensors 82 that provide feedback on pressure and temperature within the chamber. The controller 38 provides for monitoring as well as controlling the various processes and steps that occur during the lyophilization process. The controller 38 is also utilized to monitor the length of the power cycle and the various power levels depending on the requirements of the product undergoing processing. The controller 38 utilizes processing information from prior processed batches to provide optimal settings for various inputs and to optimize adjustments as processing occurs.

OPERATION

Figure 4:
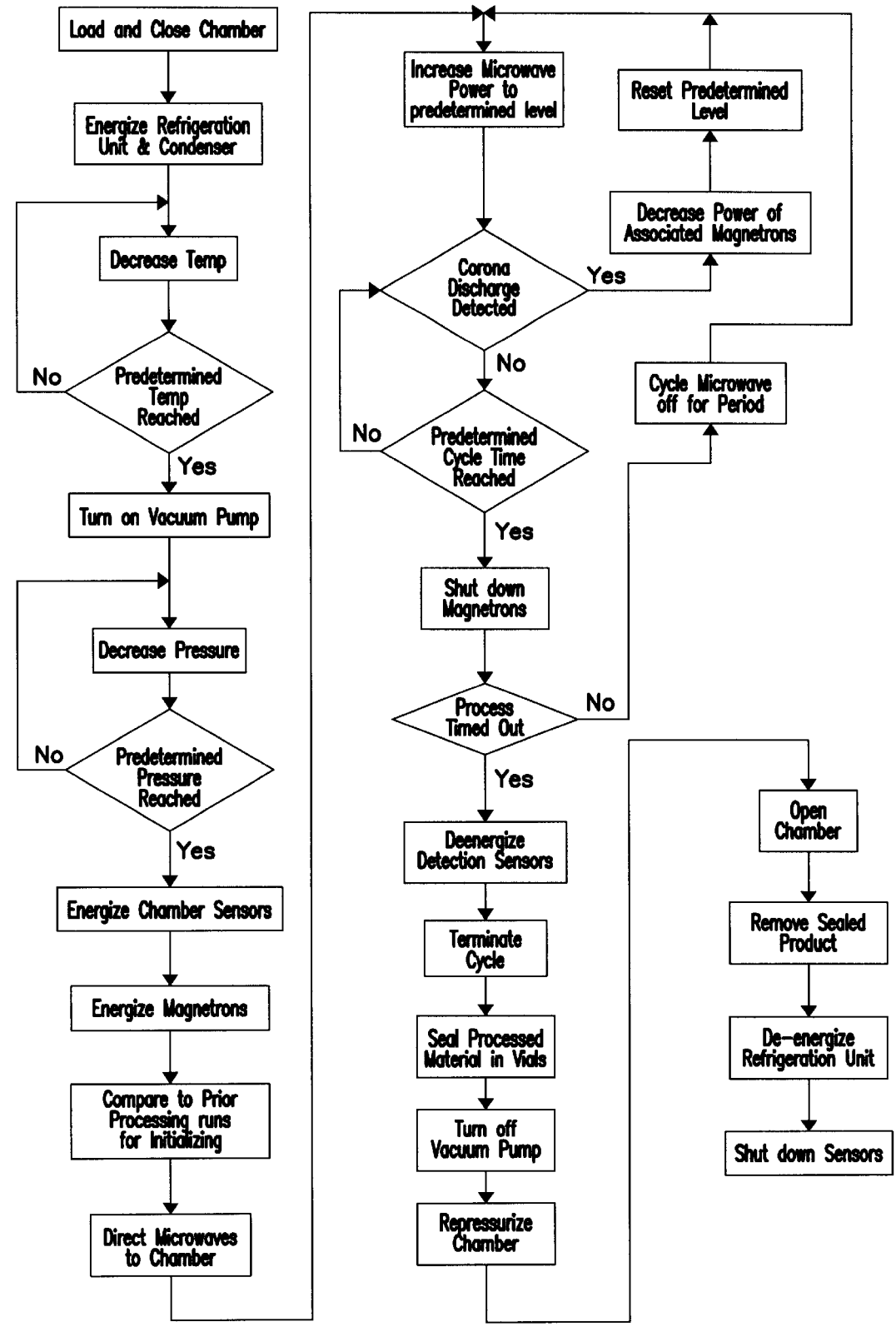
FIG. 4 shows a flow chart for controlling the lyophilization process of the microwave lyophilization system shown in FIG. 1, such as used for processing material held in vials or other sealable containers.

To begin the lyophilization process, the refrigeration unit 26 is activated and monitored, as shown in FIG. 4. Following activation of the refrigeration unit 26, the condenser 24 is also energized and its temperature controlled. The condenser 24 is cooled until predetermined temperature values have been obtained, and the vacuum pump 34 is activated and pressures monitored.

The present invention provides a system 20 that may be operated as a conventional lyophilizer using conduction, radiation and/or convection energy without microwaves, operated with a combination of conventional lyophilization and microwave energy, and operated using only microwave energy to facilitate lyophilization. When the chamber atmospheric conditions have reached a temperature and vacuum combination at which sublimation will occur, the magnetrons 40 are energized followed by the sensors including pressure and temperature sensors in the processing chamber 22. The controller 38 utilizes stored information from previous processing to initialize power levels and other settings and make adjustments throughout the processing for optimizing processing. The microwave stirrers 70 are also energized so that the microwave field is dispersed in a pattern that substantially uniformly reaches all the product within the chamber 22. The processing chamber 22 is continually monitored to determine whether incipient and/or actual corona discharges occur. If an incipient or actual corona discharge arc is detected, microwave power is reduced or shut off and the time and power level is recorded. Maximum settings may be adjusted accordingly. Chamber conditions may then be adjusted to proceed with processing without repeat of the corona discharge problems. Power may then be increased to the magnetrons 40 to a level which facilitates freeze drying, but does not create corona discharge as under previous conditions. In addition to adjusting the power of the magnetrons, and therefore the power of the microwaves in the processing chamber 22, the vacuum and temperature may be adjusted to optimize the freeze drying operation.

When the temperature, vacuum and microwave power levels have all been set at optimal values for the most efficient lyophilization without causing corona discharge, the lyophilization process is continued. Throughout the process, the product temperature, microwave power and selection of magnetrons activated are monitored to make sure they do not exceed predetermined values so that the lyophilization operation may continue without compromising quality. As the lyophilization process continues, typically the microwaves will be adjusted utilizing on/off controls and/or variable power controls to ensure efficient sublimation of the ice. These controlled variations are optimized utilizing data from multiple collection points.

When the lyophilization process has been completed, as determined by reaching a predetermined moisture content and/or having reached a predetermined operating time, the process may be shut down. The product may be held at a predetermined temperature for a predetermined period under vacuum and sealed in its vials. Sealing is performed by compressing a stopper into the vial prior to or following repressurization with air or inert gas. In operations in which the product is held in trays, the product is simply unloaded. When the product has been unloaded, the refrigeration is turned off and the condenser 24 is defrosted and drained.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the fill extent indicated by the broad general meaning of the terms in which the appended claims are expressed.

What is claimed is:

1. A lyophilizer system, adapted for operation in two modes, comprising:

a lyophilizing chamber, including shielding from microwaves;

a vacuum pumping system for creating vacuum in the lyophilizing chamber;

a microwave generator, directing microwaves into the lyophilizing chamber;

a refrigeration system for lowering the temperature of the lyophilizing chamber;

chamber operating controls for creating a chamber environment in a first mode having a temperature and a pressure that is sufficient to facilitate sublimation in the chamber, and for creating a chamber environment in a second mode having sufficient vacuum and temperature such that when combined with microwaves directed into the chamber, facilitates sublimation in the chamber;

a water vapor removal system located in or connected to the lyophilizing chamber for collecting water vapor from the lyophilizing chamber.

2. A lyophilizer system according to claim 1, wherein the lyophilizing chamber further comprises shielding from microwaves.

3. A lyophilizer system according to claim 1, further comprising a corona discharge detection system.

4. A lyophilizer system according to claim 3, further comprising a corona discharge control system for controlling power of the microwave generator in response to the corona discharge detection system.

5. A lyophilizer system according to claim 1, further comprising a microwave shielding screen intermediate the lyophilizing chamber and the condenser.

6. A lyophilizer system according to claim 1, wherein the microwave generator includes a plurality of microwave generators selectively arranged to direct microwaves at all of the material to be lypohilized in the chamber.

7. A lyophilizer system according to claim 1, further comprising a corona discharge detection and control system linked to the microwave generator for selectively varying power to the microwave generator.

8. A lyophilizer system according to claim 6, further comprising a corona discharge detection and control system linked to the plurality of microwave generators for selectively varying power to each of the microwave generators.

9. A microwave lyophilizer, comprising:

a product processing chamber;

a plurality of microwave generators and associated wave guides directed to the processing chamber, creating a microwave field;

corona discharge detection system, having at least one sensor monitoring atmospheric conditions in the processing chamber;

a controller connected to the sensors and selectively varying the power of the microwave generators in response to detected atmospheric changes in the processing chamber.

10. A microwave lyophilizer according to claim 9, further comprising shielding for removing the sensors from direct exposure to the microwave field.

11. A microwave lyophilizer according to claim 10, wherein the shielding comprises arc inhibiting surfaces in the processing chamber.

12. A microwave lyophilizer according to claim 10, wherein the sensors comprise temperature sensors.

13. A microwave lyophilizer according to claim 9, further comprising a refrigeration system and a pressurization system to create conditions that facilitate sublimation.

14. A microwave lyophilizer according to claim 11, wherein the temperature sensors comprise non-arcing fiber optic materials.

15. A microwave lyophilizer according to claim 12, wherein the temperature sensors are exterior of the microwave field.

16. A microwave lyophilizer according to claim 10, wherein the sensors comprise photo detectors.

17. A microwave lyophilizer according to claim 9, further comprising a microwave stirrer in the lyophilizing chamber.

18. A microwave lyophilizer according to claim 17, wherein the stirrer includes shielding and arc inhibiting surfaces.

19. A microwave system, comprising:

a microwave chamber;

microwave generators forming a microwave field in the chamber;

a corona discharge detection system having at least one sensor monitoring the microwave chamber for occurrences of corona discharge;

a generator controller in communication with the sensor and controlling power to the generators in response to detected discharges.

20. A microwave system according to claim 19, wherein the sensor is shielded from microwaves.

21. A microwave system according to claim 20, wherein the sensor comprises a temperature sensor.

22. A microwave system according to claim 19, further comprising microwave stirrers within the microwave chamber.

23. A microwave system according to claim 22, wherein the stirrers include arc inhibiting shielding.

24. A microwave system according to claim 22, further comprising wave guides directing microwaves into the microwave chamber at predetermined orientations and spacing.

25. A corona discharge control system for a microwave freeze dryer comprising:

a microwave generator;

at least one temperature sensor for sensing temperature increases in the freeze dryer;

a comparator for comparing the measured temperature to a desired temperature range;

controllers for controlling power of the microwave generator in response to signals from the comparator indicating detected variances from the desired temperature range, reflected power and/or light level.

26. A corona discharge control system according to claim 25, further comprising arc inhibiting shielding on the sensor.

27. A corona discharge control system according to claim 25, wherein the system includes a plurality of the sensors distributed in a spaced apart pattern forming a sensor array.

28. A lyophilizer system, adapted for operation in two modes, comprising:

a lyophilizing chamber;

a vacuum pump for creating vacuum in the lyophilizing chamber;

a microwave generator, directing microwaves into the lyophilizing chamber;

a refrigeration system for lowering the temperature of the lyophilizing chamber;

chamber operating controls for creating a chamber environment in a first mode using solely microwaves to facilitate sublimation in the chamber, and for creating a chamber environment in a second mode having sufficient vacuum and temperature such that when combined with microwaves directed into the chamber, facilitates sublimation in the chamber;

a water vapor removal system located in or connected to the lyophilizing chamber for collecting water vapor from the lyophilizing chamber.

29. A lyophilizer system, adapted for operation in two modes, comprising:

a lyophilizing chamber;

a vacuum pump for creating vacuum in the lyophilizing chamber;

a microwave generator, directing microwaves into the lyophilizing chamber;

a refrigeration system for lowering the temperature of the lyophilizing chamber;

chamber operating controls for creating a chamber environment in a first mode having a temperature and a pressure that is sufficient to facilitate sublimation in the chamber, and for creating a chamber environment in a second mode using solely microwaves to facilitate sublimation in the chamber;

a water vapor removal system located in or connected to the lyophilizing chamber for collecting water vapor from the lyophilizing chamber.

30. A lyophilizer system, adapted for operation in three modes, comprising:

a lyophilizing chamber;

a pressure controller for creating vacuum in the lyophilizing chamber;

a microwave generator, directing microwaves into the lyophilizing chamber;

a refrigeration system for lowering the temperature of the lyophilizing chamber;

chamber operating controls for creating a chamber environment in a first mode having a temperature and a pressure that is sufficient to facilitate sublimation in the chamber, for creating a chamber environment in a second mode having sufficient vacuum and temperature such that when combined with microwaves directed into the chamber, facilitates sublimation in the chamber, and for creating a chamber environment in a third mode using solely microwaves to facilitate sublimation in the chamber; and a water vapor removal system located in or connected to the lyophilizing chamber for collecting water vapor from the lyophilizing chamber.

* * * * *